US007198380B1

(12) United States Patent
Eatmon-Kral

(10) Patent No.: US 7,198,380 B1
(45) Date of Patent: Apr. 3, 2007

(54) POOL DECORATING SYSTEM

(76) Inventor: Linda S. Eatmon-Kral, 8355 Dartford Dr., Sacramento, CA (US) 95823

( * ) Notice: Subject to any disclaimer, the term of this patent is extended or adjusted under 35 U.S.C. 154(b) by 4 days.

(21) Appl. No.: 11/186,101

(22) Filed: Jul. 22, 2005

(51) Int. Cl.
*F21V 33/00* (2006.01)

(52) U.S. Cl. ..... 362/101; 362/96; 362/352; 362/450; 446/220

(58) Field of Classification Search ..... 362/96, 362/101, 352, 450; 446/220; 40/441, 571
See application file for complete search history.

(56) References Cited

U.S. PATENT DOCUMENTS 3,363,350 A * 1/1968 Moron ..... 40/441
3,672,083 A * 6/1972 Moran ..... 40/540
4,588,618 A 5/1986 Wolfe
4,662,301 A 5/1987 Wolfe
4,995,186 A * 2/1991 Collie ..... 40/591
5,101,328 A 3/1992 Hai
D372,950 S 8/1996 Nicholson
5,795,211 A * 8/1998 Carignan et al. ..... 446/220
D404,791 S 1/1999 Swiecki et al.
6,220,718 B1 4/2001 Burgess
D446,568 S 8/2001 Peterson
7,036,958 B2 * 5/2006 Hayne et al. ..... 362/352

* cited by examiner

*Primary Examiner*—Sandra O'Shea
*Assistant Examiner*—James W Cranson, Jr.

(57) ABSTRACT

A pool decorating system includes a selectively inflatable member that has a bottom side. A light assembly includes a housing having a top wall, a bottom wall and a peripheral wall that is attached to and extends between the top and bottom walls. The housing has a plurality of substantially transparent windows therein. A light emitter is mounted within the housing. A power supply is electrically coupled to the light emitter. An actuator is electrically coupled to the light emitter for selectively turning the light emitter on or off. A coupler is adapted for removably attaching the light assembly to the bottom side.

5 Claims, 6 Drawing Sheets

POOL DECORATING SYSTEM

BACKGROUND OF THE INVENTION

1. Field of the Invention

The present invention relates to pool decorating devices and more particularly pertains to a new pool decorating device which includes a plurality of inflatable members that may be illuminated and positioned in a pool.

2. Description of the Prior Art

The use of pool decorating devices is known in the prior art. U.S. Pat. No. 4,588,618 describes a device that includes a floating ornamental structure to which a plurality of secondary ornaments are attached which are attached to, and hang below the ornamental structure. Another type of pool decorating device is U.S. Pat. No. 4,662,301 having a platform with is buoyant in water and on which ornamental structures may be positioned. Yet another such device is found in U.S. Pat. No. 5,101,328 and includes a housing adapted for holding a candle which may be floated in a pool.

While these devices fulfill their respective, particular objectives and requirements, the need remains for a system that includes a plurality of inflatable members and illumination assemblies which can be selectively interchanged between the inflatable members. This allows a person to tailor the inflatable members for the required ornamental needs, such as a birthday party, a holiday, a graduation or a general celebration.

SUMMARY OF THE INVENTION

The present invention meets the needs presented above by generally comprising a selectively inflatable member that has a bottom side. A light assembly includes a housing having a top wall, a bottom wall and a peripheral wall that is attached to and extends between the top and bottom walls. The housing has a plurality of substantially transparent windows therein. A light emitter is mounted within the housing. A power supply is electrically coupled to the light emitter. An actuator is electrically coupled to the light emitter for selectively turning the light emitter on or off. A coupler is adapted for removably attaching the light assembly to the bottom side.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
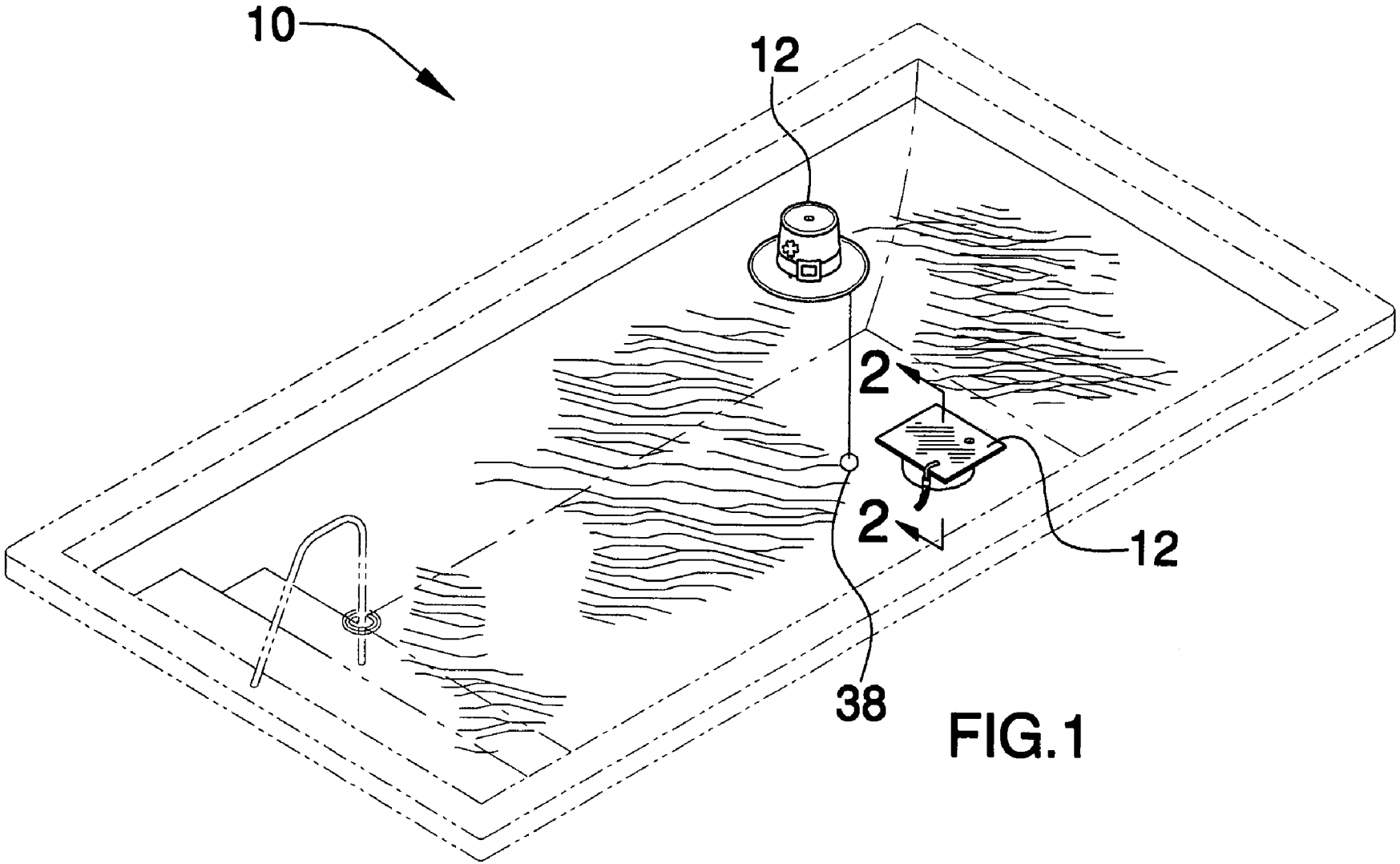
FIG. 1 is a peripheral in-use view of a pool decorating system according to the present invention.
Figure 2:
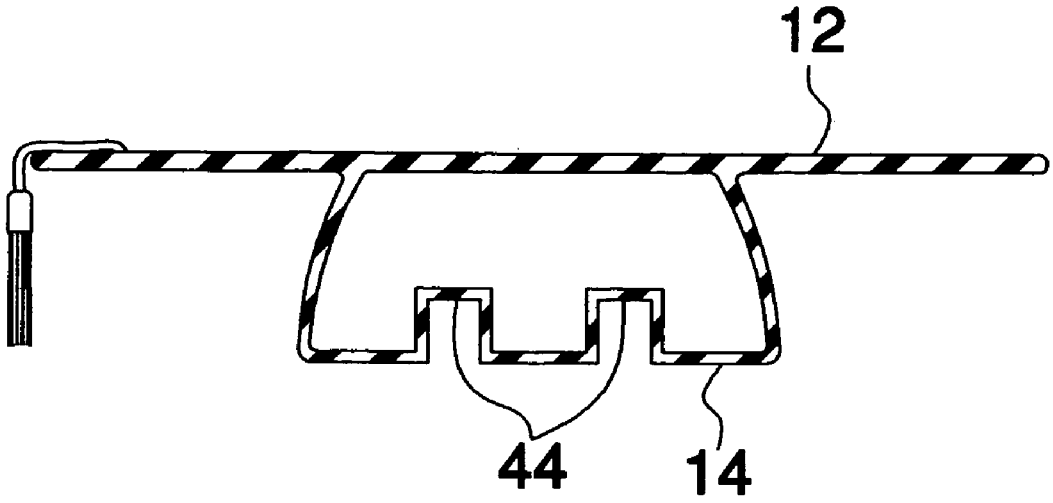
FIG. 2 is a cross-sectional view taken alone line 2—2 of FIG. 1 of the present invention.
Figure 3:
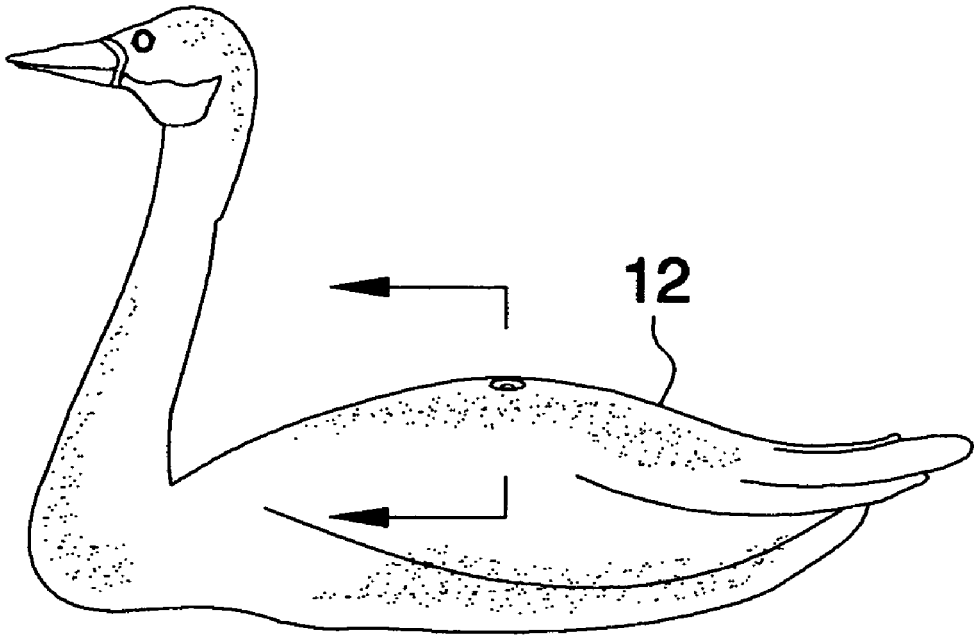
FIG. 3 is a side view of an inflatable member of the present invention.

With reference now to the drawings, and in particular to FIGS. 1 through 9 thereof, a new pool decorating device embodying the principles and concepts of the present invention and generally designated by the reference numeral 10 will be described.

Figure 4:
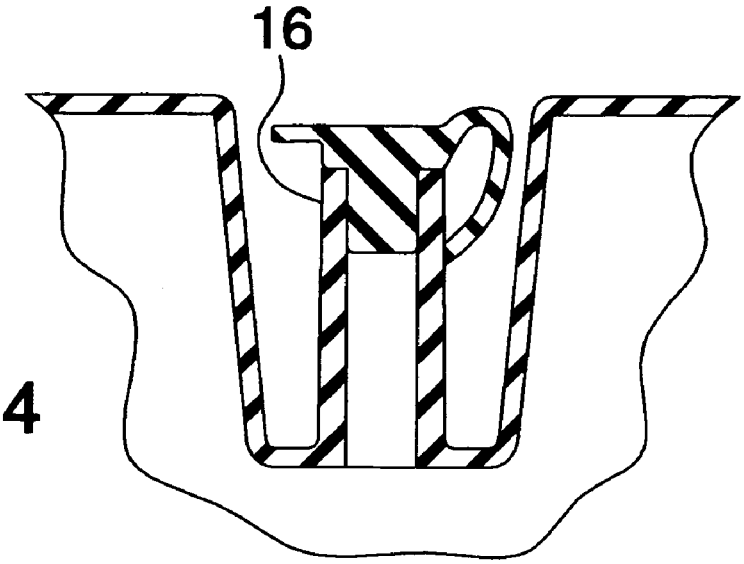
FIG. 4 is a cross-sectional view taken along line 4—4 of FIG. 3 of the present invention.
Figure 5:
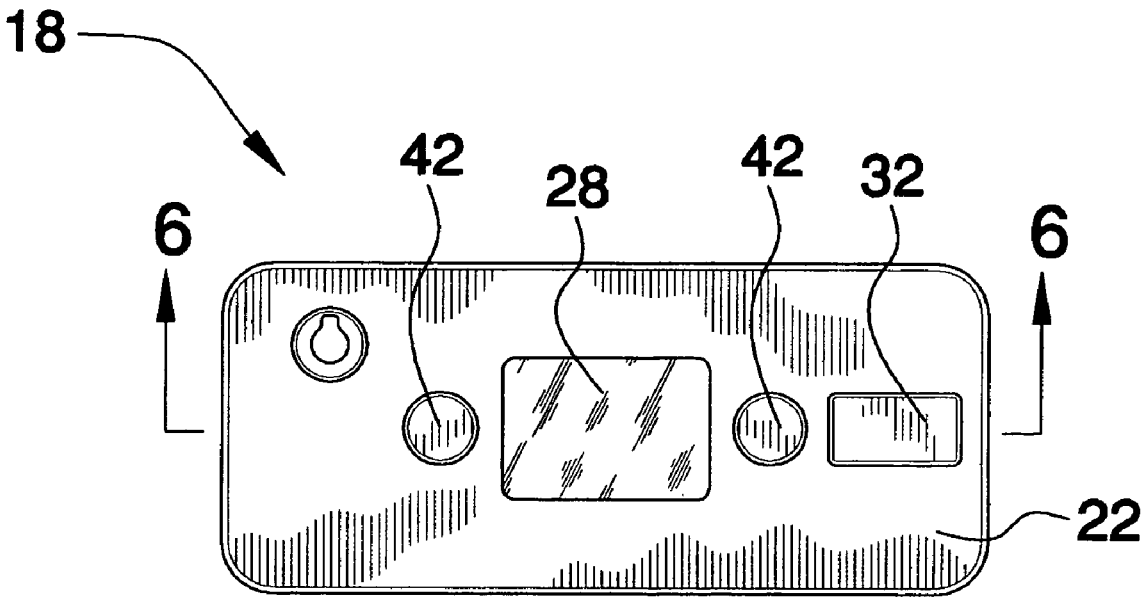
FIG. 5 is a top view of a housing of the present invention.
Figure 6:
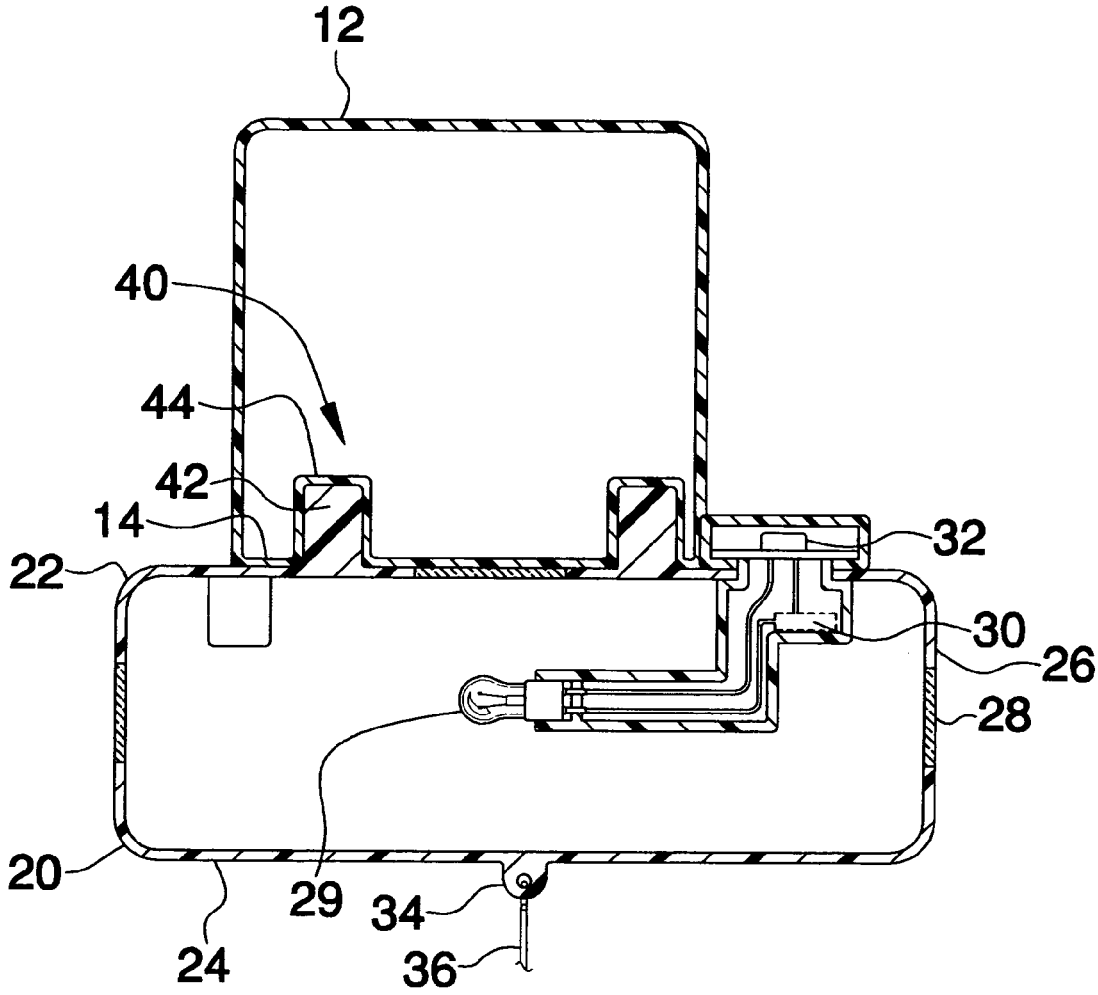
FIG. 6 is a cross-sectional view taken along line 6—6 of FIG. 5 of the present invention.
Figure 7:
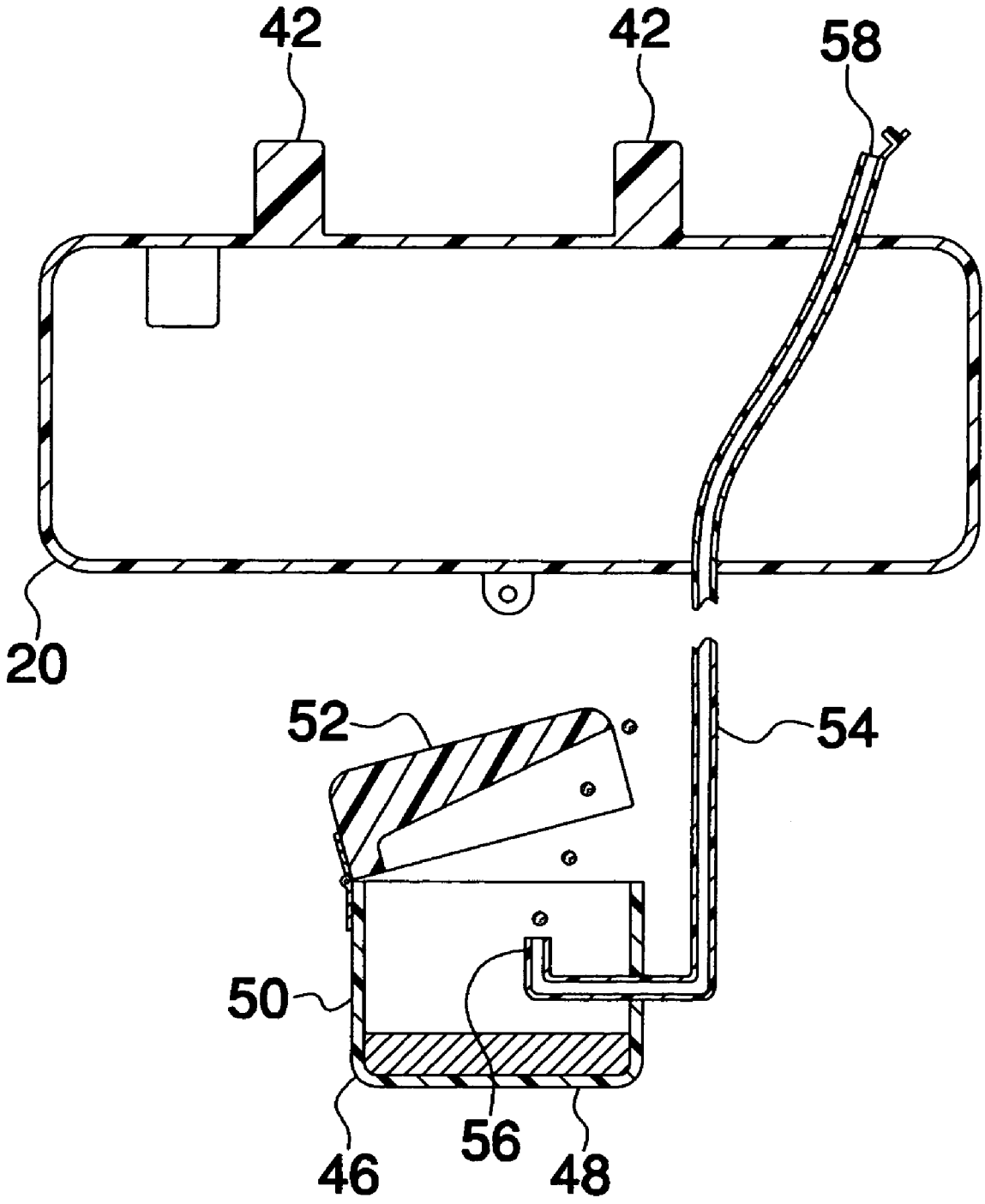
FIG. 7 is a cross-sectional view of a container of the present invention.
Figure 8:
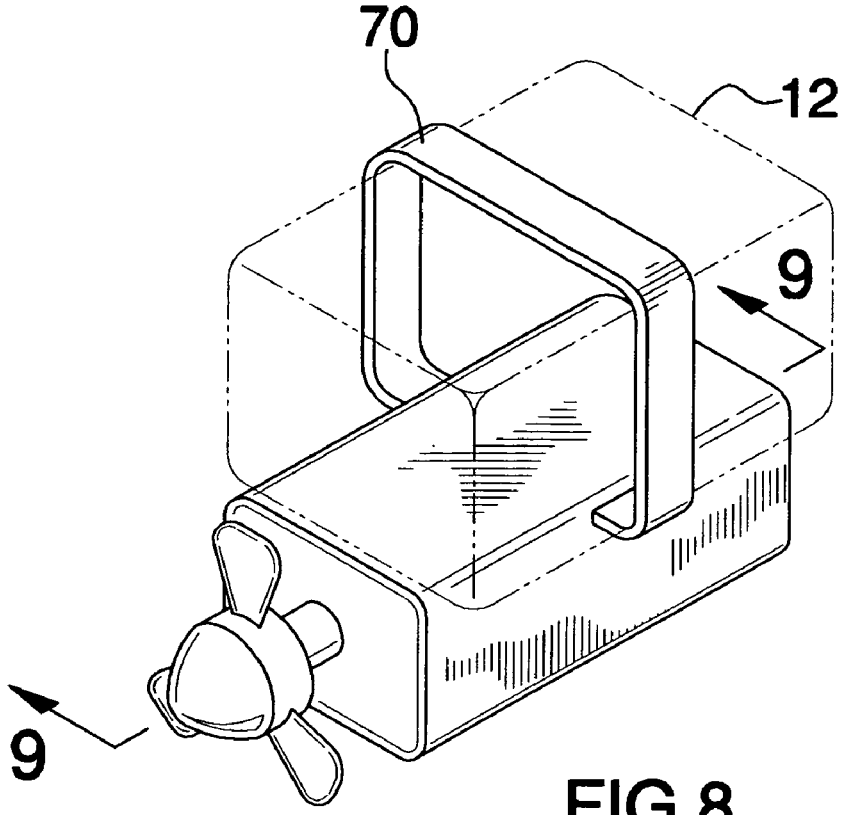
FIG. 8 is a perspective view of a vessel of the present invention.
Figure 9:
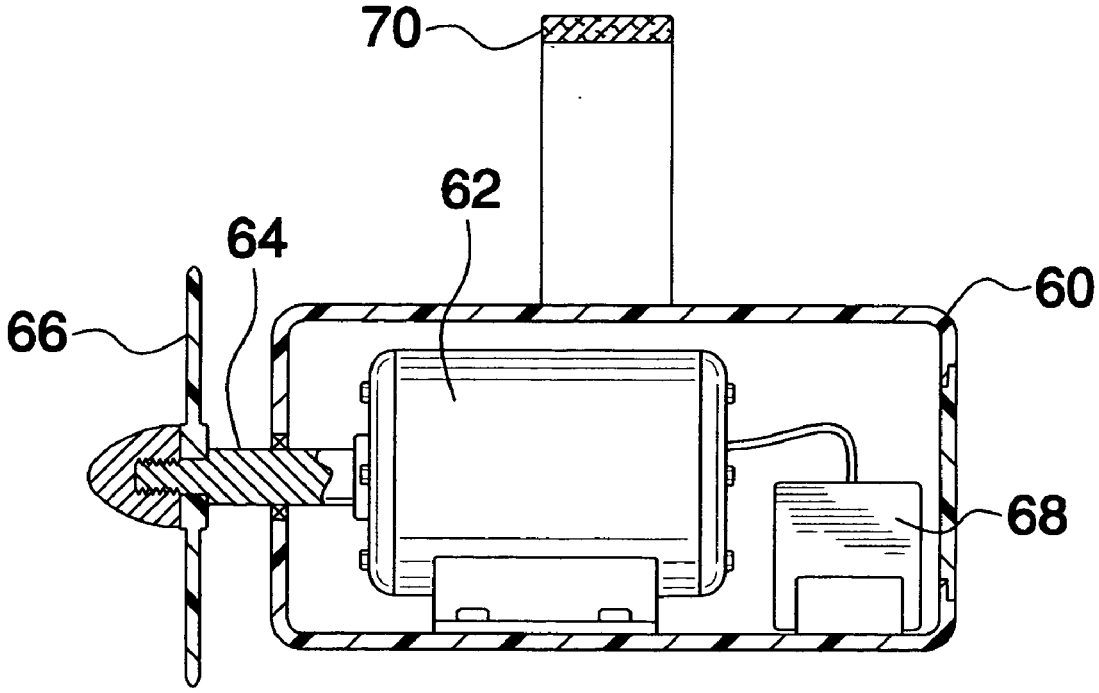
FIG. 9 is a cross-sectional view taken along line 9—9 of FIG. 8 of the present invention.

As best illustrated in FIGS. 1 through 9, the pool decorating system 10 generally comprises at least one selectively inflatable member 12 that has a bottom side 14, and preferably a plurality of inflatable members 12 each having any one of a plurality of shapes including hats, animals and the like. Each is inflatable and may be weighed down so that they sink below a surface of the water. FIGS. 6 and 8 show the inflatable members 12 in the generic. FIG. 4 depicts a conventional valve 16 which may be used for inflating the inflatable members 12.

A light assembly 18 includes a housing 20 having a top wall 22, a bottom wall 24 and a peripheral wall 26 that is attached to and extends between the top 22 and bottom 24 walls. The housing 20 has a plurality of substantially transparent windows 28 therein. A light emitter 29 is mounted within the housing 20. A power supply 30, which is preferably a battery, is electrically coupled to the light emitter 29. An actuator 32 is electrically coupled to the light emitter 29 for selectively turning the light emitter 29 on or off. A loop 34 is attached to the bottom wall 24 of the housing 20. A tether 36, with a weight 38 attached, may be secured to the loop 34. A plurality of light assemblies 18 may be furnished, one for each of the inflatable members 12.

A coupler 40 is adapted for removably attaching the light assembly 18 to the bottom side 14. The coupler 40 includes at least one, and preferably a pair of mounting posts 42. Each of the mounting posts 42 is attached to and extends upwardly from the top wall 22. The posts 42 are removably positioned in one of a pair of wells 44 extending into the bottom side 14 so that the posts 42 are frictionally coupled to surface of the wells 44.

A container 46 has a base wall 48 and a perimeter wall 50 that is attached to and extends upwardly from the base wall 48. A cover 52 is hingedly coupled to an upper edge of the perimeter wall 50 for selectively opening or closing the container 46. The container 46 is non-buoyant in water. A tube 54 has a first end 56 a second end 58. The first end 56 extends through the perimeter wall 50 and is positioned within the container 46. The tube 54 extends through the housing 20 so that the second end 58 of the tube 54 extends away from the top wall 22 of the housing 20. Air may be injected through the tube 54 so that air in the container 46 urges the cover 52 upwardly.

A vessel 60 is provided. A motor 62 is mounted in the vessel 60 and a shaft 64, mechanically coupled to the motor 62, extends outwardly through the vessel 60. The motor 62 rotates the shaft 64 when turned on. A propeller 66 is attached to an outer end of the shaft 64. A power supply 68, which is preferably a battery, is mounted in the vessel 60 and is electrically coupled to the motor 62. A band 70 is attached to the motor 62. The band 70 is selectively extendable around one of the inflatable members 12 to propel the corresponding inflatable member 12 around a water surface.

In use, the inflatable members 12 are inflated. Each of the lighting assemblies 18 is attached to a bottom side 14 of one of the inflatable members 12 so that the lighting assemblies 18 illuminate the inflatable members 12. The container 46 is allowed to sink to the bottom of a pool and air may be blown therein to simulate the opening and closing of a chest. If desired, the vessel 60 may be used for propelling one of the inflatable members 12 around a pool.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A decorative assembly for a pool, said assembly comprising:

a selectively inflatable member having a bottom side;

a light assembly including a housing having a top wall, a bottom wall and a peripheral wall being attached to and extending between said top and bottom walls, said housing having a plurality of windows therein, a light emitter being mounted within said housing, a power supply being electrically coupled to said light emitter, an actuator being electrically coupled to said light emitter for selectively turning said light emitter on or off, said light emitter emitting light through said windows when said light emitter is turned on; and a coupler removably attaching said light assembly to said bottom side.

2. The assembly according to claim 1, wherein said coupler includes a pair of mounting posts, each of said mounting posts being attached to and extending upwardly from said top wall, each of said posts being removably positioned in one of a pair of wells extending into said bottom side such that said posts are frictionally coupled to surface of said wells.

3. The assembly according to claim 1, further including a container having a base wall and a perimeter wall being attached to and extending upwardly from said base wall, a cover being hingedly coupled to an upper edge of said perimeter wall for selectively opening or closing said container, said container being non-buoyant in water, a tube having a first end a second end, said first end extending through said perimeter wall and being positioned within said container, said tube extending through said housing such that said second end of said tube extends away from said top wall of said housing, wherein air may be injected through said tube such that air in said container urges said cover upwardly.

4. The assembly according to claim 1, further including a vessel, a motor being mounted within said vessel, a shaft extending outwardly through said vessel and being mechanically coupled to said motor such that said motor rotates said shaft, a propeller being attached to an outer end of said shaft a power supply being mounted in said vessel and electrically coupled to said motor, a band being attached to said motor, said band being selectively extendable around said inflatable member.

5. A decorative assembly for a pool, said assembly comprising:

a selectively inflatable member having a bottom side;

a light assembly including a housing having a top wall, a bottom wall and a peripheral wall being attached to and extending between said top and bottom walls, said housing having a plurality of substantially transparent windows therein, a light emitter being mounted within said housing, a power supply being electrically coupled to said light emitter, an actuator being electrically coupled to said light emitter for selectively turning said light emitter on or off, a loop being attached to said bottom wall of said housing;

a coupler being adapted for removably attaching said light assembly to said bottom side, said coupler including pair of mounting posts, each of said mounting posts being attached to and extending upwardly from said top wall, each of said posts being removably positioned in one of a pair of wells extending into said bottom side such that said posts are frictionally coupled to surface of said wells;

a container having a base wall and a perimeter wall being attached to and extending upwardly from said base wall, a cover being hingedly coupled to an upper edge of said perimeter wall for selectively opening or closing said container, said container being non-buoyant in water, a tube having a first end a second end, said first end extending through said perimeter wall and being positioned within said container, said tube extending through said housing such that said second end of said tube extends away from said top wall of said housing, wherein air may be injected through said tube such that air in said container urges said cover upwardly; and a vessel, a motor being mounted within said vessel, a shaft extending outwardly trough said vessel and being mechanically coupled to said motor such that said motor rotates said shaft, a propeller being attached to an outer end of said shaft, a power supply being mounted in said vessel and electrically coupled to said motor, a band being attached to said motor, said band being selectively extendable around said inflatable member.

* * * * *